United States Patent [19]

Lynch et al.

[11] Patent Number: 4,729,861

[45] Date of Patent: Mar. 8, 1988

[54] METHOD OF MAKING GOLF BALLS

[75] Inventors: Francis deS. Lynch, Mattapoisett; John W. Jepson, Marion; Robert A. Brown, Mattapoisett, all of Mass.

[73] Assignee: Acushnet Company, New Bedford, Mass.

[21] Appl. No.: 713,298

[22] Filed: Mar. 18, 1985

Related U.S. Application Data

[60] Division of Ser. No. 213,056, Dec. 4, 1980, which is a continuation of Ser. No. 91,087, Nov. 5, 1979, abandoned, which is a continuation of Ser. No. 920,396, Jun. 29, 1978, abandoned, which is a continuation of Ser. No. 816,882, Jul. 18, 1977, abandoned, which is a continuation of Ser. No. 716,100, Aug. 20, 1976, abandoned, which is a continuation of Ser. No. 363,353, May 24, 1973, abandoned, which is a continuation-in-part of Ser. No. 236,318, Mar. 20, 1972, abandoned.

[51] Int. Cl.[4] ..... A63B 37/14

[52] U.S. Cl. ..... 264/219; 156/146; 156/245; 264/239; 273/232

[58] Field of Search ..... 156/146, 245; 273/232; 264/219, 239, 293, 299, 320, 325

[56] References Cited

U.S. PATENT DOCUMENTS

| | | | |
|---|---|---|---|
| 4,090,716 | 5/1978 | Martin et al. | 273/232 |
| 4,142,727 | 3/1979 | Shaw et al. | 273/232 |
| 4,256,304 | 3/1981 | Smith et al. | 273/232 |
| 4,346,898 | 8/1982 | Badke | 273/232 |
| 4,560,168 | 12/1985 | Aoyama | 273/232 |

*Primary Examiner*—Caleb Weston

*Attorney, Agent, or Firm*—Lucas & Just

[57] ABSTRACT

Dimples are arranged on the surface of a golf ball in a manner which makes the golf ball travel further. At least about 80% of the distances between the closest points of the edges of adjacent dimples are less than about 0.065 inches and at least about 55% of the distances between the closest points of the edges of adjacent dimples are greater than about 0.001 inches.

24 Claims, 18 Drawing Figures

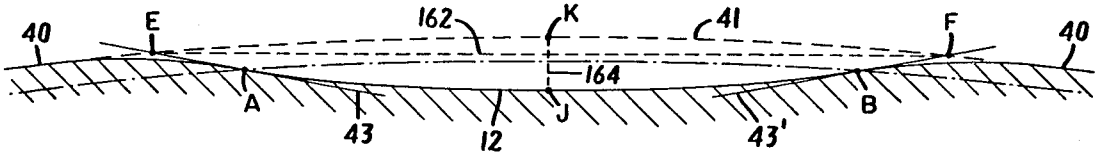
FIG. 14
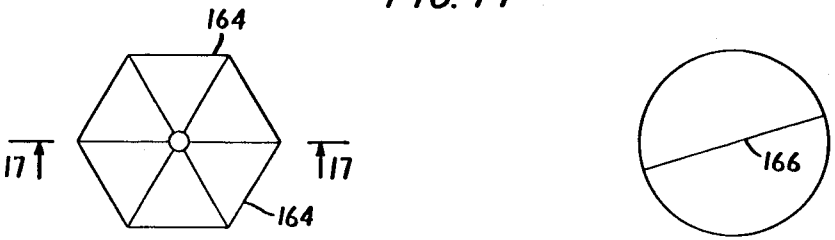
FIG. 15
FIG. 16
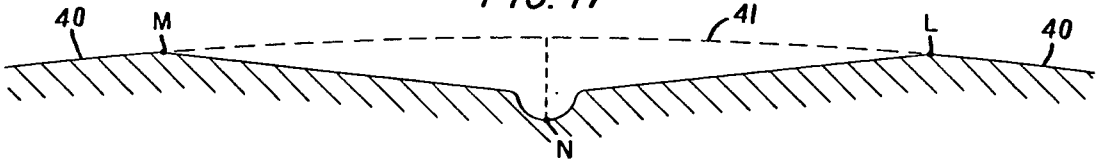
FIG. 17
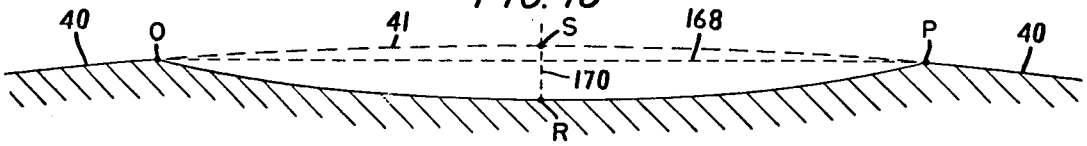
FIG. 18

METHOD OF MAKING GOLF BALLS

The present application is a divisional application of application Ser. No. 213,056 filed Dec. 4, 1980 which in turn was a continuation of application Ser. No. 091,087 filed Nov. 5, 1979 and now abandoned, which in turn was a continuation of application Ser. No. 920,396 filed June 29, 1978 and now abandoned, which in turn was a continuation of application Ser. No. 816,882 filed July 18, 1977 and now abandoned, which in turn was a continuation of application Ser. No. 716,100 filed Aug. 20, 1976 and now abandoned, which in turn was a continuation of application Ser. No. 363,353 filed May 24, 1973 and now abandoned, which in turn was a continuation-in-part of application Ser. No. 236,318 filed Mar. 20, 1972 and now abandoned.

The present invention relates to the spatial relationships of dimples on the surface of golf balls. By having most of the adjacent dimples no more than about 0.065 inches apart, the golf ball will travel further than a standard golf ball which is identical except for the spatial arrangement of the dimples.

For many years golf balls have had dimples on their surfaces in order to increase their aerodynamic properties whereby the ball will travel further than a smooth golf ball. By the term "dimple" it is meant an indentation in the surface of a golf ball. There have been various attempts to improve the distance obtained from a golf ball by varying the configuration of an individual dimple such as by making its diameter larger, its depth shallower, or even changing the dimple from a round to a square configuration. It has now been discovered that increased yardage can be obtained from a golf ball in which the spatial relationships of the dimples are controlled so that at least about 80% of the land distances of adjacent dimples are less than about 0.065 inches and at least about 55% of the land distances of adjacent dimples are greater than about 0.001 inches. By the term "land distance" it is intended to mean the distance between the edges of the two dimples at their closest points. The edge of the dimple is defined as the point at which the periphery of the golf ball or its continuation intersects a tangent to the sidewall of the dimple and will be hereinafter more fully explained. Since only about 55% of the land distances are greater than about 0.001 inches, it will be understood that some of the dimples may overlap. Overlapping dimples may have a negative land distance as land distance is herein defined.

It has further been discovered that when the land area between adjacent dimples is controlled within the limits as set forth in this specification, the relative size and number of the dimples is unimportant. Standard golf balls contain about 336±10 dimples on their surface. It has been found that the number of dimples on the golf ball can be varied substantially and that increased yardage will still be obtained when the limits on land distances as taught in this specification and claims are followed. It has additionally been found that the shape of the dimple is not critical. Although the preferred dimple is round, the dimple may be oval, pentagonal, hexagonal, octagonal or other shapes. In addition, more than one shape of dimple may be used on a single ball, if desired. When the term diameter is used herein, it is defined as the distance from edge to edge when the dimple is circular. When the dimple is non-circular, the term diameter is defined as the diameter of a circle which would have the same area as the area of the non-circular dimple. When the term depth is used herein it is defined as the distance from the continuation of the periphery line to the deepest part of a dimple which is a section of a sphere. When the dimple is not a section of a sphere, the depth in accordance with the present invention is computed by taking a cross section of the dimple at its widest point. The area of the cross section is computed and then a section of a circle of equal area is substituted for the cross section. The depth is the distance from the continuation of the periphery line to the deepest part of the section of the circle. Golf balls according to the present invention have been made with 122 dimples, 182 dimples, 252 dimples, 332 dimples and 392 dimples among others.

The critical values in accordance with the present invention are that at least about 80% of the distances between the closest points of the edges of adjacent dimples must be less than about 0.065 inches and at least about 55% of the distances between the closest points of the edges of adjacent dimples must be greater than about 0.001 inches.

There is additional advantage in controlling the depth to diameter ratio of the individual dimples. In determining the depth to diameter ratio it is necessary to include the number of dimples to be used on the ball. The basic formula for this determination is as follows:

$$S = \left[\frac{831.5(d-x) - 55.56(D-y)}{a}\right]^2 + \left[\frac{83.15(D-y) + 555.6(d-x)}{b}\right]^2$$

wherein:

d=average depth of all dimples in inches

D=average diameter of all dimples in inches

S=computed unknown (1.0 or less for present invention)

In accordance with the present invention, the computed unknown, S, will always be 1.0 or less. S can be equal to 0 but it will otherwise always be a positive number.

For a golf ball having from about 182 to about 332 dimples, the values of x, y, a, and b in accordance with the present invention will be:

$$y=0.323-0.086N+0.0122N^2$$

$$x=0.0186-0.00406N+0.000550N^2$$

$$a=6.30-3.30N+0.693N^2$$

$$b=3.11-1.03N+0.155N^2$$

N=the exact number of dimples divided by 100

This is designated as Formula 1.

For a golf ball having from 333 to about 392 dimples the same basic formula is used with the following x, y, a, and b values:

$$y=0.287-0.0383N$$

$$x=0.0162-0.00150N$$

$$a=4.66-0.500N$$

$$b=5.00-1.08N$$

N=the exact number of dimples divided by 100

This is designated as Formula 2. Again, when S is equal to or less than 1 the depth to diameter relationship is in accordance with the present invention.

For golf balls having from 182 to 332 dimples, even better results are obtained with the basic formula when:

$$y=0.323-0.0896N+0.122N^2$$

$$x=0.0186-0.00406N+0.000550N^2$$

$$a=4.54-2.78N+0.674N^2$$

$$b=3.09-1.97N+0.412N^2$$

N=the exact number of dimples by 100

This is designated as Formula 3. It is to be pointed out that all golf balls included in Formula 3 are also included in Formula 1.

For golf balls having from 333 to 392 dimples, even better results are obtained with the basic formula when:

$$y=0.240-0.0242N$$

$$x=0.0225-0.00340N$$

$$a=13.6-3.28N$$

$$b=5.25-1.25N$$

N=the exact number of dimples divided by 100

This is designated as Formula 4. It is to be pointed out that all golf balls included in Formula 44 are also included in Formula 2.

It will be understood that there is not a sharp break between 332 and 333 dimples and that, in fact, the formulas given hereinbefore overlap in this general area. Different sets of formulas have been given for 182–332 and 333–392 dimpled balls only for the purpose of simplication since a single set of formulas for all balls would be unduly complicated. However, no matter which set of formulas is used, best results are obtained when the golf ball has from about 315 to about 340 dimples and the following values are employed in the basic formula:

x=0.0117
y=0.156
a=1.1
b=0.55

This is designated as Formula 5. Golf balls which are within this best results formula will also be included within Formulas 2 and 4 and thus necessarily within Formulas 1 and 3.

The preferred method of applying the formulas is to plot a graph of d vs. D vs. N, holding S at 1. (For Formula 5, since there is no "N" in the formula the graph will simply be a plot of d vs. D holding S at 1). The plotting of this graph is well within the skill of the art. Once the graph has been plotted, selection of one of the variables on the graph will automatically yield the other two variables.

An alternative method of applying the formulas is to first select the number of dimples to be used and then arbitrarily select a diameter and depth. If when these numbers are inserted in the appropriate formula S=1 or less, then the depth and diameter are in accordance with the present invention. For Formula 5, the depths and diameters can be the same whether the number of dimples is about 315 or about 340 or any number therebetween.

The following will serve as illustrative examples of selecting dian. ter and depth according to the present invention. Of course, the dimples were positioned on the ball in accordance with the present invention.

EXAMPLE 1

In this case it was decided to have 252 dimples which comes within Formula 1. The diameter was selected as 0.175 inches and the depth as 0.0145 inches. These values were substituted into Formula 1 and S computed as about 1.9. Since S is greater than 1.0, the depth to diameter relationship is not in accordance with the present invention.

EXAMPLE 2

Example 1 was repeated holding the dimple number at 252 and the diameter at 0.175 inches. In this case, however, the depth of the dimple were decreased to 0.0135 inches. When these values were substituted into Formula 1, S equalled about 0.7 which is less than 1.0 and thus the depth to diameter relationship was in accordance with the present invention. These distances are shown on FIG. 2 since they are within the present invention.

EXAMPLE 3

Example 2 was repeated using the same values i.e., 252 dimples, diameter of 0.175 inches and depth of 0.0135 inches. In this case, however, the values were substituted into Formula 3 to find out whether or not these values give "better" results. S was computed to be about 2.3 which is greater than 1.0 thereby indicating that these values, while within the present invention, do not give "better" results.

EXAMPLE 4

Example 3 was repeated holding the dimple number at 252 and the diameter at 0.175 inches but in this case the depth of the dimple was decreased to 0.0125 inches. When these values were substituted into Formula 3, S equalled about 0.4 which is less than 1.0 thereby indicating that these values give "better" results.

EXAMPLE 5

In this case it was decided to use 392 dimples, which comes within Formula 2. The diameter was selected as 0.130 inches and the depth as 0.009 inches. When these values were substituted into Formula 2, S was found to be about 3.0. Since S is greater than 1, the depth and diameter are not in the proper ratio in accordance with the present invention.

EXAMPLE 6

Example 5 was repeated holding the number of dimples at 392 and the depth at 0.009 inches. However, the diameter was increased to 0.140 inches. In this case S is 0.6 which is less than 1.0 and thus the depth to diameter relationship is within the limits of the present invention.

EXAMPLE 7

When Example 6 was repeated using the same values, i.e., 392 dimples, depth of 0.009 inches and diameter of 0.140 inches, but using Formula 4, S was computed to be 2.3 Since Formula 4 is the formula to be used to obtain "better" results and since the values of this example give a value greater than 1.0 in Formula 4, it is seen that these values, while within the present invention, do not give "better" results.

EXAMPLE 8

Example 7 was repeated holding the dimple number at 392 and the depth at 0.009 inches but in this case the diameter was increased to 0.145 inches. When these values were substituted in Formula 4, S was found to be 0.1. Since S is less than 1.0, these values give "better" results.

EXAMPLE 9

In this case it was decided to have 315 dimples which comes within the best results formula i.e., Formula 5. The diameter was selected as 0.150 inches and the depth as 0.0125 inches. These values were substituted into Formula 5 and S computed as about 0.8. Since S was less than 1.0, the depth to diameter relationship is within the "rest results" of the present invention.

EXAMPLE 10

Example 9 was repeated using the same depth and diameter i.e., 0.150 inches and 0.0125 inches but in this case the golf ball had 340 dimples. Again, the S value equalled 0.8 and thus the ball was within the "best results" region of the present invention.

These and other aspects of the present invention may be more fully understood with reference to the following drawings in which:

FIG. 14 shows the method of measuring the depth and diameter of a spherically shaped dimple;

FIGS. 15 and 16 show the method of computing the diameter of an irregularly shaped dimple; and FIGS. 17 and 18 show the method of computing the depth of an irregularly shaped dimple.

Figure 1:
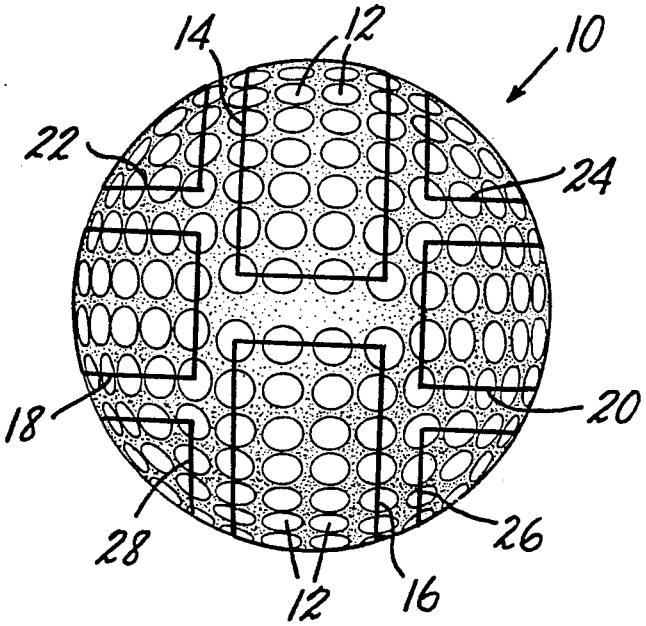
FIG. 1 is the top half of a golf ball with dimples arranged as in today's standard golf ball.

Referring now to FIG. 1, there is seen a golf ball partially in section with dimples arranged in the manner customarily employed today. Virtually, all golf balls on the market today have dimples arranged in accordance with this pattern. For each hemisphere of the golf ball 10, the dimples 12 are arranged in two large rectangles 14 and 16, two small rectangles 18 and 20, and four triangles 22, 24, 26, and 28. Because of molding techniques, the opposite side of the golf ball virtually always has the same dimple pattern. It has been found that more than 33% of the land areas of adjacent dimples are more than 0.065 inches apart in this golf ball, even if the dimples are as large as 0.155 inches.

Figure 2:
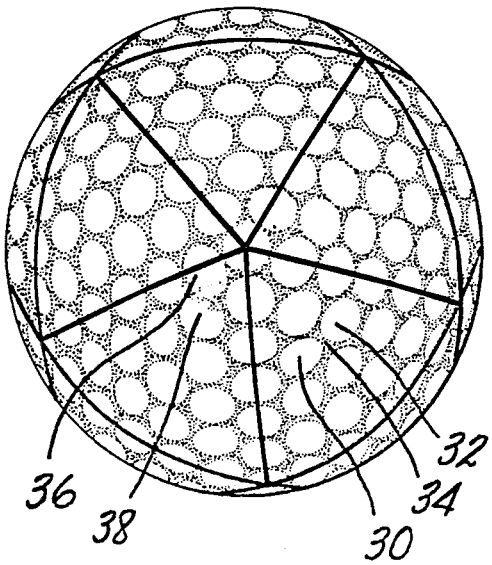
FIG. 2 is the top half of a golf ball showing dimples in accordance with the present invention.

In FIG. 2 there is shown a golf ball made in accordance with the present invention. As indicated on the drawing, at least about 80% of the land areas of adjacent dimples are no greater than about 0.065 inches and no more than about 55% of the land areas of adjacent dimples are less than about 0.001 inches. As can be seen with reference to dimples 30 and 32, the distance 34 between the closest points of these two dimples may be more than 0.065 inches. It is only necessary that the distance between adjacent dimples be less than 0.065 inches for at least about 80% of such distances. Similarly, as can be seen with reference to dimples 36 and 38, there is a negative distance between the edges of the dimple since the edges overlap. In accordance with the present invention it is only necessary that at least about 55% of the distances between dimples at their closest points be greater than 0.001 inches. However, where the dimples overlap, the negative distance should in most cases be no greater than about 0.02 inches. The size of the dimples is relatively unimportant and can be varied within the diameters and depths as given hereinbefore. Different size dimples may be used on the same golf ball, if desired, provided that the critical distances between the edges of adjacent dimples at their closest points is maintained within the values as set forth herein.

Figure 3:
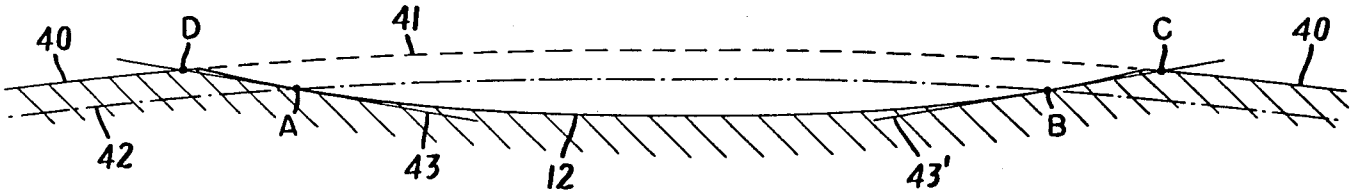
FIGS. 3–5 are cross sections of dimples showing the method of determining the edge of the dimple.
Figure 4:
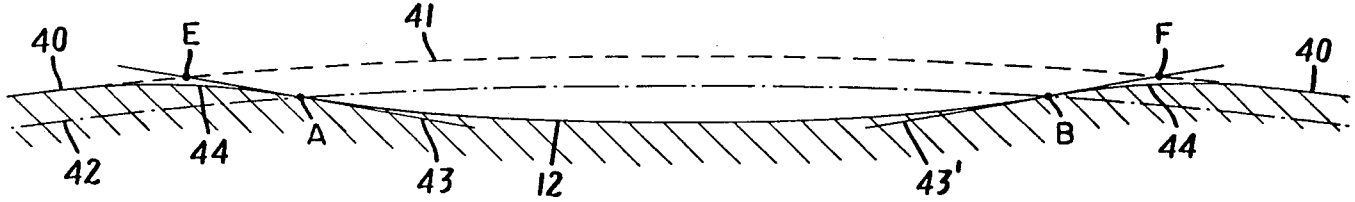
Figure 5:
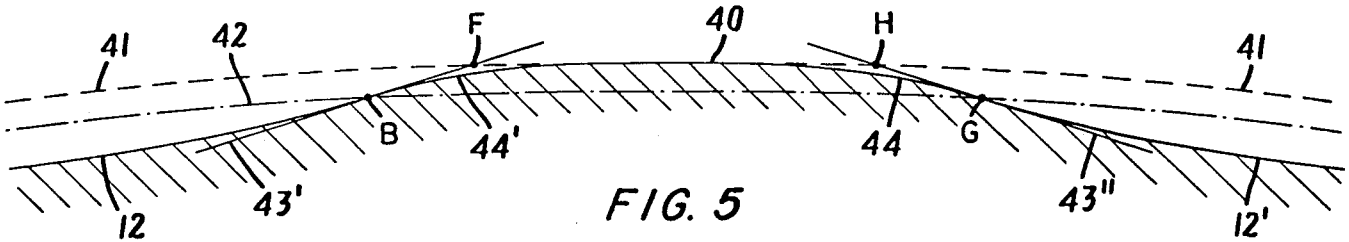

Referring to FIGS. 3–5, there is seen the method of determining the point which comprises the edge of the dimple. The edge of the dimple is defined as that point at which the periphery of the golf ball or its continuation intersects a tangent to the sidewall of the dimple, said tangent being at a point about 0.003 inches from the periphery of the ball or its continuation.

In FIG. 3 is seen in cross section a golf ball having periphery 40 and continuation thereof 41 and dimple 12. The periphery and its continuation are a substantially smooth section of a sphere. Arc 42 is about 0.003 inches below curve 40-41-40 and intersects the dimple 12 at points A and B. Tangents 43 and 43' are tangent to the dimple 12 at points A and B respectively and intersect periphery 40 at points C and D respectively. Points C and D are the edges of the dimple.

In FIG. 4 is seen a golf ball with dimple 12 which has a rounded top 44. The dimple, in three dimensions, is a section of a sphere. Arc 42 is about 0.003 inches below curve 40-41-40 and intersects dimple 12 at points A and B. Tangents 43 and 43' are tangent to the dimple 12 at points A and B respectively and intersect periphery continuation 41 at points E and F respectively. Points E and F are the edges of the dimple.

Turning now to FIG. 5 there is shown a golf ball in cross section having dimples 12 and 12' partially shown with rounded tops 44 and 44'. Arc 42 is about 0.003 inches below curve 41-40-41 and intersects dimples 12 and 12' at points B and G respectively. Tangent 43' and 43'' are tangent to the dimples 12 and 12' at points B and G respectively. Tangents 43' and 43'' intersect periphery continuation 41 at points F and H respectively. Points F and H are the edges of dimples 12 and 12'' respectively. The "land distance" between dimples 12 and 12' is measured along curve 41-40-41 from point F to point H.

Referring to FIGS. 6–9 there is seen the method of determining what is an "adjacent" dimple. An adjacent dimple is defined as one in which a triangle constructed of lines passing through the center points of 3 dimples has no included angle less than about 30°, and has no part of another dimple included therein.

Figure 6:
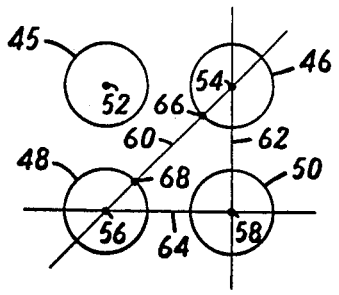
FIGS. 6–9 show a series of dimples and illustrate what is an "adjacent" dimple.

Turning now to FIG. 6 there are shown 4 dimples, 45, 46, 48 and 50, having centers 52, 54, 56, and 58 respectively. If the center point of dimples 46, 48 and 50 are joined by lines, a triangle is formed having sides 60, 62, and 64 as shown. As can be seen, each of the included angles in this triangle is greater than about 30° and no part of another dimple is included within the triangle. Therefore, dimple 46 is adjacent to dimple 48, dimple 46 is adjacent to dimple 50, and dimple 48 is adjacent to dimple 50. Since in accordance with the present invention all dimples are circular or are converted to the circular, the closest points between the two dimples on the edges of the dimple will fall on the line which passes through the center of the two adjacent dimples. The closest points at the edges between dimples 46 and 48 are edge points 66 and 68, and therefore, the critical land distance as described hereinbefore is measured between points 66 and 68 for these adjacent dimples.

Figure 7:
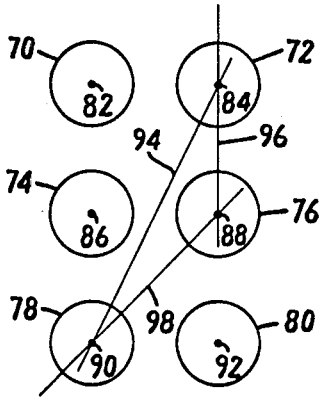
Figure 8:
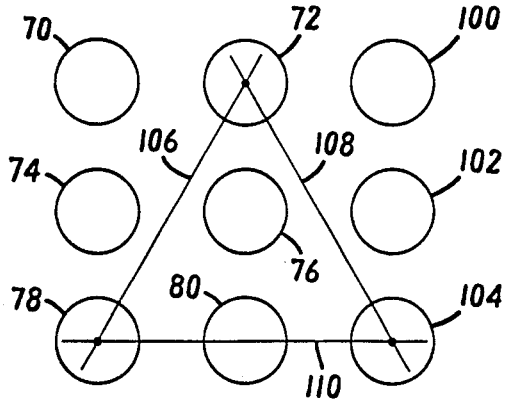

In FIG. 7 is shown a set of dimples 70, 72, 74, 76, 78, and 80, having centers 82, 84, 86, 88, 90, and 92, respectively. As shown with reference to FIG. 6, dimples 76 and 78 are "adjacent." If a triangle is formed by drawing lines through the center points of dimples 72, 78, and 76, it is seen that dimples 72 and 78 are not adjacent since the included angles formed by lines 94, 96, and by lines 94, 98 are less than 30°.

Referring to FIG. 8, there is again shown dimples 70, 72, 74, 76, 78, and 80, as well as dimples 100, 102 and 104. Lines 106, 108, and 110 form a triangle, passing through the centers of dimples 72, 78 and 104. Each of the included angles of this triangle is greater than 30°. However, dimple 72 is not adjacent to dimple 78 since at least a part of another dimple is included within the triangle. In this case, the entire dimple 76 is included within the triangle and half of the dimple 80 is included within the triangle.

Figure 9:
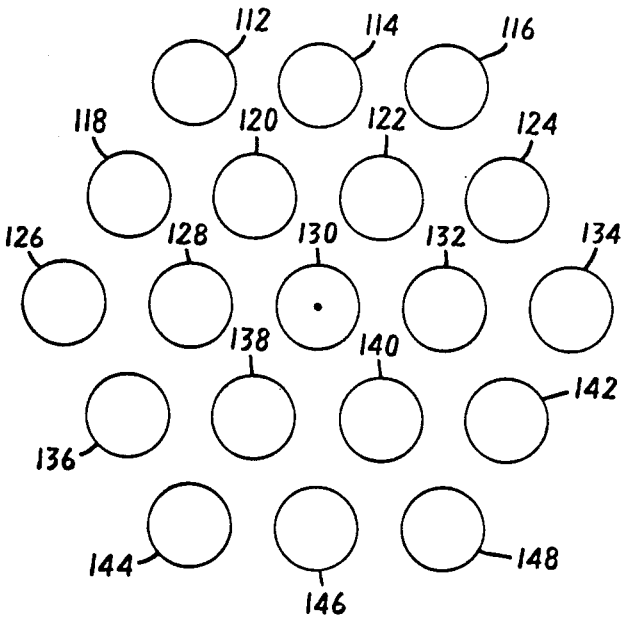

In FIG. 9 is shown a series of dimples 112, 114, 116, 118, 120, 122, 124, 126, 128, 130, 132, 134, 136, 138, 140, 142, 144, 146, and 148. Referring to dimple 130, dimples 120, 122, 128, 132, 138, and 140 are adjacent thereto since a triangle can be formed with lines passing through the center points of each of these dimples without including at least a portion of another dimple and each included angle of the said triangles will be greater than about 30°. None of the dimples 112, 114, 116, 118, 124, 126, 134, 136, 142, 144, 146, or 148 are adjacent to dimple 130 since no triangle can be drawn through the center point of three dimples including one of these dimples and dimple 130 which will not include at least a section of another dimple and which will have no angle of the triangle less than about 30°.

With further reference to FIG. 9, it will be understood that for dimple 122, adjacent dimples are 114, 116, 120, 124, 130 and 132. With reference to the dimple 140, the adjacent dimples are 130, 132, 138, 142, 146, and 148 and so forth with respect to each of the dimples. For determining the critical values of having at least about 80% of the dimples being no further apart than about 0.065 inches and at least about 55% of the dimples being no closer than about 0.001 inches, the distance between each dimple and each of its adjacent dimples is measured. However, duplicate measurements are not included. Thus, with respect to dimple 130, the distance between it and dimples 120, 122, 128, 132, 138, and 140, are included, but thereafter with respect to the dimple 122, the distance between it and dimple 130 would not be included since this has already been included with respect to dimple 130.

Maximum benefit is obtained when 100% of adjacent dimples have a distance between them at their closest points of less than about 0.065 inches and when 100% of the minimum distances between the closest points of adjacent dimples are greater than about 0.001 inches.

Figure 10:
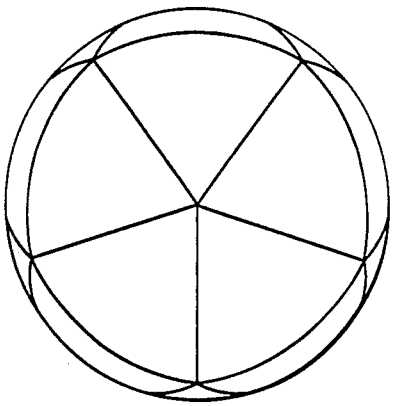
FIGS. 10–13 show one suitable method of arranging the dimples on the surface of the golf ball.
Figure 11:
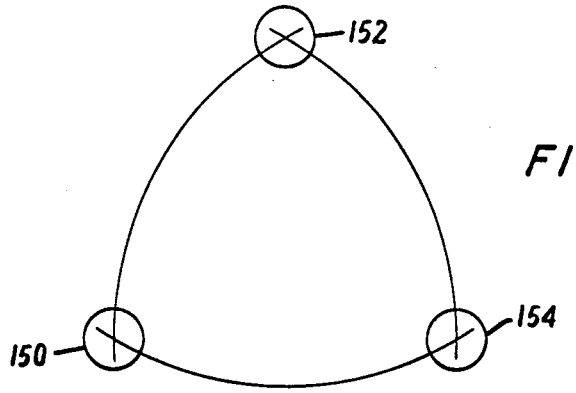
Figure 12:
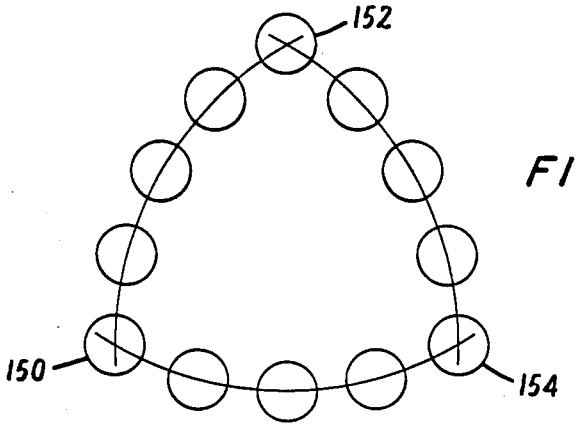
Figure 13:
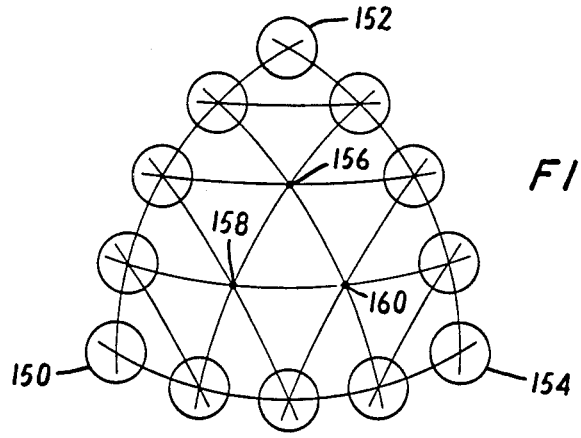

The mechanics of positioning the dimples on the golf ball is not our invention. One suitable method is to first determine the diameter of the dimple to be used. The diameter of the dimple is preferably within the range of about 0.125 inches to about 0.245 inches. The golf ball surface is then broken down into an icosahedron which, in effect, triangulates the surface of the golf ball as shown partially in FIG. 10. Each of the "triangles" of the icosahedron is equilateral as shown in FIG. 11. Vertex dimples 150, 152, and 154 are situated on each of the vertices of the triangle as shown with the center of the dimple being at the vertex of each angle. Additional dimples are then situated on the sides of the "triangle." The positioning of their centers is determined by the diameter of the dimple and the "land distance" between adjacent dimples which is held within the limits as previously given. The additional dimples on the sides of the "triangle" are shown in FIG. 12. Great circles are then made between dimples which are about equidistance from the vertex dimples connecting all of the center points of the dimples on the sides of the "triangle." Additional dimples are placed where these great circles intersect. As shown in FIG. 13, these great circles intersect at points 156, 158, and 160. These points are the center points for additional dimples. This procedure is then followed with respect to each of the other "triangles" of the icosahedron. Naturally, a dimple at the vertex of three contiguous "triangles" will be a vertex dimple for each of the three triangles. It will be understood that the number of dimples on the sides of the "triangle" will vary inversely with the diameter of the dimple. According to the number of dimples on the sides of the "triangle," the number of great circles will also vary and therefore the number of dimples within the "triangle" will also vary since an additional dimple is placed wherever the great circles intersect.

The above method is only illustrative and need not be adhered too rigidly and the dimples need not be evenly spaced so long as the spacing of the dimples is within the critical limitations as hereinbefore given. Golf balls are usually made with two mold "halves" and it is convenient to adjust the dimples in the vicinity of the mold line so that no dimples fall on the partition line of the molds. In this manner, there is less difficulty in removing any "flash" from a dimple.

In FIG. 14 is shown the method of measuring the depth and diameter of a spherically shaped dimple. The dimple in this case is shown in cross section and is the same dimple as shown in FIG. 4. The diameter is measured from the edges of the dimples, points E and F, along line 162 which is a straight line. Point J is the deepest part of the dimple 12. The depth is measured from point K on the continuation of the periphery 41 to point J and is indicated by line 164. Line 164 is perpendicular to line 162.

In FIGS. 15 and 16 is shown the method of computing the diameter of an irregularly shaped dimple. FIG. 15 shows the top of a hexagonally shaped dimple as one looks directly at it and all six sides 164 are shown at the edges of the dimple. The area of the hexagonally shaped dimple is approximately 0.01765 square inches. FIG. 16 is a circle which has an equivalent area to the hexagonal area of FIG. 15 i.e, the area of the circle of FIG. 16 is 0.01765 square inches. The diameter of FIG. 16 is shown as 166 and this diameter is approximately 0.150 inches. Thus, in accordance with the present invention, the diameter of the hexagonally shaped dimple of FIG. 15 is 0.150 inches. It is important to note that the diameter of an irregularly shaped dimple is not measured directly on the irregularly shaped dimple but is always a diameter of a circle which has an area equivalent to that of the irregularly shaped dimple.

In like manner, the depth of an irregularly shaped dimple is computed on the basis of a spherically shaped dimple. In FIG. 17 is shown a cross section of an irregularly shaped dimple which in this case is the same dimple as is shown in FIG. 15. For purposes of determining the depth of the dimple, the cross section is always taken across the widest part of the dimple which passes through the deepest part of the dimple. The edge of the dimple is shown at points L and M and was determined in accordance with the present invention as set out in FIGS. 3 and 4. The periphery is shown at 41 and the deepest point of the dimple is shown at point N. The area of the cross section of the dimple up to the continuation of the periphery (as shown, enclosed by lines M,N, N,L, and L,M along line 41) is computed and found to be 0.00113 square inches. The equivalent area of a section of a circle is then substituted for the dimple as shown in FIG. 18. Points O and P are the edges of the diameter of an equivalent dimple as determined in accordance with FIGS. 15 and 16 and line 168 is a straight line between lines O and P and corresponds to the diameter line 166 of FIG. 16. Point R is the deepest part of the dimple and line 170 is perpendicular to line 168. Line 170 intersects the continuation of the periphery 41 at point S and the depth as measured from point S to point R is 0.0113 inches. It is important to note that in accordance with the present invention the depth of the dimple is measured from a cross section of a circle having an equivalent area to that of a cross section of the irregularly shaped dimple rather than being measured on the actual dimple.

In all cases, measurements made in accordance with the present invention are made on a finished golf ball, since it is the final form of the golf ball which affects aerodynamic properties as opposed to some intermediate construction of the golf ball. In most cases, a finished golf ball will have one or more layers of paint affixed to the surface thereof and in these cases the measurements are made after the final coat of paint or other surface finish has been applied. With some of the new solid balls, however, a finished ball will not have any surface layer such as paint since it is not necessary. It will be understood that in these cases a finished ball means a ball that is unpainted. It will therefore be understood that the term "finished ball" can cover either a painted or an unpainted ball but in either case means the completed ball in the form in which it is intended to be sold to the consumer.

It will be understood that the claims are intended to cover all changes and modifications of the preferred embodiments of the invention, herein chosen for the purpose of illustration, which do not constitute departures from the spirit and scope of the invention.

What is claimed is:

1. A method of manufacturing a golf ball having dimples in the outer periphery thereof comprising the steps of:

(A) selecting a golf ball structure onto the surface of which dimples can be molded;

(B) determining the dimple number, dimple diameter and dimple depth by:

(a) selecting the number of dimples to be used, the said number of dimples being between 182 and 392;

(b) selecting a dimple diameter and dimple depth that satisfy the following relationship:

$$S = \left[\frac{831.5(d-x) - 55.56(D-y)}{a}\right]^2 + \left[\frac{83.15(D-y) + 555.6(d-x)}{b}\right]^2$$

in which:

S=a value of 0 to 1.0 d=average depth of all dimples in inches

D=average diameter of all dimples in inches and wherein:

a value N is obtained by dividing the exact number of dimples by 100, and x, y, a and b are defined by the following relations as functions of N:

when the number of dimples is between 182 and 332:

$$y=0.323-0.0896N+0.0122N^2$$

$$x=0.0186-0.00406N+0.000550N^2$$

$$a=6.30-3.30N+0.693N^2$$

$$b=3.11-1.03N+0.155N^2$$

and when the number of dimples is between 333 and 392:

$$y=0.287-0.0383N$$

$$x=0.0162-0.00150N$$

$$a=4.66-0.500N$$

$$b=5.00-1.08N$$

(C) making golf ball molds by positioning the selected dimples on the golf ball mold so that the surface of the golf ball made therefrom will have at least 80% of the distances between the closest points of the edges of adjacent dimples less than about 0.065 inches, and at least 55% of the distances between the closest points of the edges of adjacent dimples greater than 0.001 inches the edge of the dimples being defined as the point of intersection of the periphery of the golf ball or its continuation and a tangent to the sidewall of the dimples at a point 0.003 inches below the periphery of the golf ball or its continuation;

(D) forming the dimples on the surface of the golf ball by molding a golf ball in the mold;

(E) removing the formed golf ball from the mold; and (F) finishing the golf ball.

2. The method of claim 1 wherein the positioning of the selected dimples in the surface of the golf ball is such that 100% of the closest distances between the edges of adjacent dimples is less than 0.065 inches.

3. The method of claim 1 wherein the positioning of the selected dimples in the surface of the golf ball is such that 100% of the closest distance between the edges of adjacent dimples is greater than 0.001 inches.

4. The method of claim 1 wherein the dimples are circular.

5. The method of claim 1 wherein the selected number of dimples is from 182 to 332 and x, y, a and b are defined by the following relations as functions N:

$$y=0.323-0.0896N+0.0122N^2$$

$$x=0.0186-0.00406N+0.000550N^2$$

$$a=4.54-2.78N+0.674N^2$$

$$b=3.09-1.97N+0.412N^2.$$

6. The method of claim 5 wherein the positioning of the selected dimples in the surface of the golf ball is such that 100% of the closest distances between the edges of the adjacent dimples is less than 0.065 inches.

7. The method of claim 6 wherein the positioning of the selected dimples in the surface of the golf ball is such that 100% of the closest distances between the edges of adjacent dimples is greater than 0.001 inches.

8. The method of claim 6 wherein the dimples are circular.

9. The method of claim 1 wherein the selected number of dimples is from 333 to 392 and x, y, a and b are defined by the following relations as functions of N:

$$y=0.287-0.0383N$$

$$x=0.0162-0.00150N$$

$$a=4.66-0.500N$$

$$b=5.00-1.08N.$$

10. The method of claim 9 wherein the positioning of the selected dimples in the surface of the golf ball is such that 100% of the closest distances between the edges of adjacent dimples is less than 0.0065 inches.

11. The method of claim 9 wherein the positioning of the selected dimples in the surface of the golf ball is such that 100% of the closest distances between the edges of the adjacent dimples is greater than 0.001 inches.

12. The method of claim 9 wherein the dimples are circular.

13. The method of claim 1 wherein the selected number of dimples is from 182 to 332 and x, y, a and b are defined by the following relations as functions of N:

$$y=0.323-0.0896N+0.0122N^2$$

$$x=0.0186-0.00406N+0.000550N^2$$

$$a=6.30-3.30N+0.693N^2$$

$$b=3.09-1.97N+0.412N^2.$$

14. The method of claim 13 wherein the positioning of the selected dimples in the surface of the golf ball is such that 100% of the closest distances between the edges of adjacent dimples is less than 0.065 inches.

15. The method of claim 13 wherein the positioning of the selected dimples in the surface of the golf ball is such that 100% of the closest distances between the edges of adjacent dimples is greater than 0.001 inches.

16. The method of claim 15 wherein the dimples are circular.

17. The method of claim 1 wherein the selected number of dimples is from 333 to 392 and x, y, a and b are defined by the following relations as functions of N:

$$y=0.240-0.0242N$$

$$x=0.0225-0.00340N$$

$$a=13.6-3.28N$$

$$b=5.25-1.25N.$$

18. The method of claim 17 wherein the positioning of the selected dimples in the surface of the golf ball is such that 100% of the closest distances between the edges of adjacent dimples is less than 0.065 inches.

19. The method of claim 17 wherein the positioning of the selected dimples in the surface of the golf ball is such that 100% of the closest distances between the edges of adjacent dimples is greater than 0.001 inches.

20. The method of claim 17 wherein the dimples are circular.

21. The method of claim 17 wherein the selected number of dimples is from 315 to 340 and x, y, a and b are as follows:

x=0.0117
y=0.156
a=1.1
b=0.55.

22. The method of claim 21 wherein the positioning of the selected dimples in the surface of the golf ball is such that 100% of the closest distances between the edges of adjacent dimples is less than 0.065 dimples.

23. The method of claim 21 wherein the positioning of the selected dimples in the surface of the golf ball is such that 100% of the closest distances between the edges of adjacent dimples is greater than 0.001 inches.

24. The method of claim 21 wherein the dimples are circular.

* * * * *

UNITED STATES PATENT AND TRADEMARK OFFICE

CERTIFICATE OF CORRECTION

PATENT NO. : 4,729,861

DATED : March 8, 1988

INVENTOR(S) : Francis deS. Lynch et al.

It is certified that error appears in the above-identified patent and that said Letters Patent are hereby corrected as shown below:

Column 1, line 41, delete "the" (second instance).

Column 2, line 48, change "0.086N" to --0.0896N--.

Column 3, line 14, after "dimples" insert --divided--.

Column 3, line 31, change "44" to --4--.

Column 5, line 6, change "in" to --into--.

Column 6, line 47, change "12" " to --12'--.

Column 10, line 67, after "functions" insert --of--.

Column 11, line 12, change the dependency from "claim 6" to --claim 5--.

Column 11, line 16, change the dependency from "claim 6" to --claim 5--.

Column 11, line 32, change "0.0065" to --0.065--.

UNITED STATES PATENT AND TRADEMARK OFFICE

CERTIFICATE OF CORRECTION

PATENT NO. : 4,729,861

DATED : March 8, 1988

INVENTOR(S) : Francis deS. Lynch et al

It is certified that error appears in the above-identified patent and that said Letters Patent is hereby corrected as shown below:

Column 12, line 9, change the dependency from "claim 15" to --claim 13--.

Signed and Sealed this

Eighteenth Day of October, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,729,861

DATED : March 8, 1988

INVENTOR(S) : Francis deS. Lynch et al.

It is certified that error appears in the above-identified patent and that said Letters Patent is hereby corrected as shown below:

Column 12, line 32, change the dependency from "claim 17"

to read -- claim 1 --.

Signed and Sealed this

Thirty-first Day of January, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,729,861

DATED : March 8, 1988

INVENTOR(S) : Francis deS. Lynch et al.

It is certified that error appears in the above-identified patent and that said Letters Patent is hereby corrected as shown below:

Column 4, line 17, after "dimple" change "were" to --was--;

Column 5, line 17, change "rest" to --best--;

Column 6, line 43, change "Tangent" to --Tangents--;

Column 7, line 52, change "distance" to --distances--;

Column 8, line 13, change "equidistance" to --equidistant--;

Column 10, line 61, change "distance" to --distances--;

Column 11, line 36, delete "the"; and

Column 12, line 43, after "0.065" delete "dimples" and substitute therefor --inches--.

UNITED STATES PATENT AND TRADEMARK OFFICE

CERTIFICATE OF CORRECTION

PATENT NO. : 4,729,861

DATED : March 8, 1988

INVENTOR(S) : Francis deS. Lynch et al.

It is certified that error appears in the above-identified patent and that said Letters Patent is hereby corrected as shown below:

Column 11, line 50, change "$b=3.09-1.97N+0.412N^2$" to --$b=3.11-1.03N+0.155N^2$--.

Signed and Sealed this

Twenty-seventh Day of November, 1990

*Attest:*

HARRY F. MANBECK, JR.

*Attesting Officer*

*Commissioner of Patents and Trademarks*